United States Patent [19]

Castonguay et al.

[11] 4,301,342

[45] Nov. 17, 1981

[54] CIRCUIT BREAKER CONDITION INDICATOR APPARATUS

[75] Inventors: Roger N. Castonguay, Terryville; Charles L. Jencks, Avon, both of Conn.

[73] Assignee: General Electric Company, New York, N.Y.

[21] Appl. No.: 162,282

[22] Filed: Jun. 23, 1980

[51] Int. Cl.[3] ..... H01H 9/20; H01H 73/12

[52] U.S. Cl. ..... 200/153 SC; 200/308; 335/17

[58] Field of Search ..... 200/153 SC, 153 G, 153 H, 200/308; 335/17, 13, 20, 26, 27, 28, 166, 167, 168, 169, 170, 171, 172, 173, 174, 175

[56] References Cited

U.S. PATENT DOCUMENTS

| | | | |
|---|---|---|---|
| 4,166,989 | 9/1979 | Castonguay et al. | 335/17 |
| 4,220,936 | 9/1980 | Powell | 200/153 SC |
| 4,251,702 | 2/1981 | Castonguay et al. | 200/153 SC |

*Primary Examiner*—Harold Broome

*Attorney, Agent, or Firm*—Richard A. Menelly; Walter C. Bernkopf; Philip L. Schlamp

[57] ABSTRACT

In an industrial circuit breaker having a spring-powered movable contact operating mechanism and a spring-powered charging mechanism, each having the facility of storing a charge rendering the circuit breaker capable of being closed, condition indicator apparatus includes a first indicator for indicating whether the breaker movable contacts are open or closed and a second indicator for indicating whether or not a charge is stored in either the operating mechanism or the charging mechanism.

10 Claims, 10 Drawing Figures

CIRCUIT BREAKER CONDITION INDICATOR APPARATUS

REFERENCE TO RELATED APPLICATIONS

The instant application is related to the commonly assigned, concurrently filed patent applications entitled Circuit Breaker Trip Latch Assembly Ser. No. 162,281, Flux Shifter Reset Assembly Ser. No. 162,280, Undervoltage Release Reset and Lockout Apparatus Ser. No. 162,271, Circuit Breaker Electrical Closure Control Apparatus Ser. No. 162,278, and Circuit Breaker Hook Apparatus Ser. No. 162,279.

BACKGROUND OF THE INVENTION

The present invention relates to industrial circuit breakers and particularly to apparatus for indicating the condition thereof.

The subject condition indicator apparatus has particular application to store energy reclosure type circuit breakers, such as that disclosed in commonly assigned, copending application Ser. No. 52,276, filed June 25, 1979 now Pat. No. 4,251,702. The disclosure of this copending application is specifically incorporated herein by reference. As therein disclosed, a circuit breaker is equipped with a separate spring-powered charging mechanism which is charged and then discharged to charge a spring-powered operating mechanism capable, when charged, to propel breaker movable contacts from a tripped open position to a closed position and, when discharged or tripped, from their closed position to their tripped open position. A hook is utilized to releaseably hold the movable contacts in an intermediate hooked open position against the closing force of a charged operating mechanism. Thus, the hook, in effect, stores the charge in the operating mechanism for subsequent utilization to motivate closure of the circuit breaker. A prop sensitive to the condition of the operating mechanism is utilized to store a charge in the charging mechanism while the former is in a charged condition, i.e., the movable contacts are in either of their hooked open or closed positions. When the charged operating mechanism is discharged, the movable contacts are propelled to their tripped open position effective in removing the prop, and the charge stored in the charging mechanism is automatically expended in recharging the operating mechanism. The circuit breaker is thus rendered capable of reclosure.

In a circuit breaker having such reclosure capability, it is important to indicate not only whether the breaker contacts are open or closed, but also whether a charge is stored in either the operating mechanism by the hook or the charging mechanism by the prop, and thus indicate whether or not the circuit breaker is capable of reclosure regardless of the position of the movable contacts.

It is accordingly an object of the present invention to provide improved condition indicator apparatus for utilization in spring-powered reclosure type circuit breakers.

A further object is to provide indicator apparatus of the above character for indicating whether the breaker contacts are open or closed.

Another object is to provide indicator apparatus of the above character for indicating whether or not the breaker is capable of closure while its contacts are open and whether or not the breaker is capable of reclosure while the breaker contacts are closed.

An additional object is to provide condition indicator apparatus of the above character which is efficient in construction and reliable in operation.

SUMMARY OF THE INVENTION

In accordance with the present invention, there is provided apparatus for reliably and fully indicating to personnel the condition of a reclosure-type industrial circuit breaker. That is, the subject condition indicator apparatus indicates whether the breaker is open or closed and whether or not the breaker is capable of closure or reclosure. To this end, the condition indicator apparatus includes a first indicator arm mounted for movement between OFF and ON indicating positions. This arm is positioned to its OFF indicating position in response to the breaker movable contacts being in an open position. While so positioned, a display panel carried by this first arm registers indicia in a breaker cover window identifying that the breaker is open. In response to the breaker movable contacts assuming their closed position, the first arm is shifted to its ON indicating position to register display panel borne indicia in the cover window identifying the fact that the breaker is closed.

The condition indicator apparatus also includes a second indicator arm mounted for movement between CHARGED and DISCHARGED indicating positions. If a charge is stored in the breaker movable contact operating mechanism by hook apparatus releaseably holding the movable contacts in a hooked open position against the closing force of the charged operating mechanism, the second indicator arm is responsively shifted to its CHARGED indicating position. So positioned, a display panel borne by this arm registers indicia in a breaker cover window identifying the fact that the breaker is capable of being closed. If a charge is stored in a separate reclosure enabling charging mechanism operative, when discharged, to recharge the movable contact operation mechanism, the second indicator arm is also positioned in its CHARGED indicating position to manifest the fact that the breaker is capable of reclosure regardless of whether the movable contacts are in the closed or hooked open position. In the absence of a charge stored in either the operating mechanism or the charging mechanism, the second indicator arm is responsively shifted to its DISCHARGED indicating position to register indicia in the cover window identifying the fact that the breaker is incapable of closure if the breaker contacts are open or incapable of reclosure if the breaker contacts are closed.

The invention accordingly comprises the features of construction and arrangement of parts which will be exemplified in the construction hereinafter set forth, and the scope of the invention will be indicated in the claims.

For a better understanding of the nature and objects of the invention, reference should be had to the following detailed description taken in conjunction with the accompanying drawings in which:

DESCRIPTION OF THE DRAWINGS

Corresponding reference numerals refer to like parts throughout the several views of the drawings.

DETAILED DESCRIPTION

Figure 1:
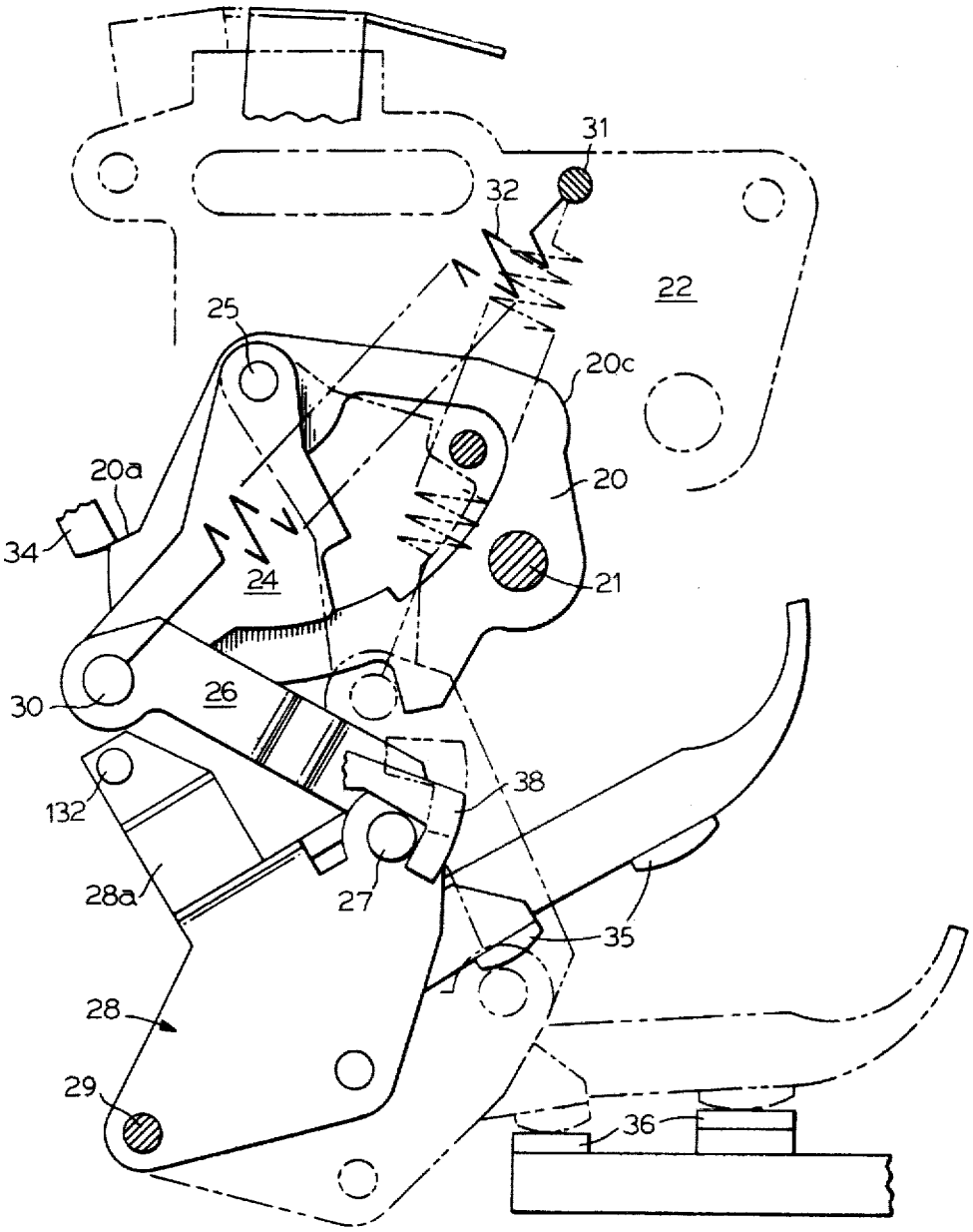
FIG. 1 is a side elevational view of a circuit breaker spring-powered movable contact operating mechanism.

Turning to the drawings, there is shown in FIG. 1, a circuit breaker movable contact operating mechanism corresponding to that disclosed in the above-noted copending application, Ser. No. 52,276. Thus, a cradle 20 is fixedly mounted on a pin 21 journalled by opposed mechanism frame sideplates 22. A toggle linkage consisting of an upper link 24 and a lower link 26 connects cradle 20 to a center pole movable contact assembly 28, pivotally mounted at 29. Specifically, the upper end of link 24 is pivotally connected to the cradle by a pin 25, while the lower end of link 26 is pivotally connected to the center pole movable contact assembly by a pin 27. The other ends of these toggle links are pivotally interconnected by a knee pin 30. Mechanism tension springs 32 act between the toggle knee pin and a stationary pin 31 supported between the frame sideplates 22.

From the description thus far, it will be noted that, by virtue of the position of spring anchoring pin 31, the line of action of the mechanism springs, while in their charged state by virtue of cradle 20 being in its latched reset position sustained by the engagement of a latch 34 with cradle latch shoulder 20*a*, is always situated to the right of the upper toggle link pivot pin 25. Thus, the mechanism springs continuously act to straighten the toggle. Since straightening of the toggle forces the movable contact assemblies 28, ganged together by crossbar 28*a*, to pivot downwardly to their phantom line, closed circuit position with their movable contacts 35 engaging stationary contacts 36, the circuit breaker is always biased toward contact closure while cradle 20 is latched in its reset position.

To control the moment of contact closure, a hook 38 engages pin 27 to hold movable contact assemblies 28 in a hooked open circuit position while the cradle is latched in its reset position and while it is being returned to its latched, reset position from a clockwise-most tripped position to charge the mechanism springs. Thus the toggle is maintained collapsed to the left as seen in FIG. 1. When the hook is removed, the movable contact assemblies 28 are pivoted to their closed circuit positions as springs 32 act to abruptly straighten toggle links 24, 26.

Figure 2:
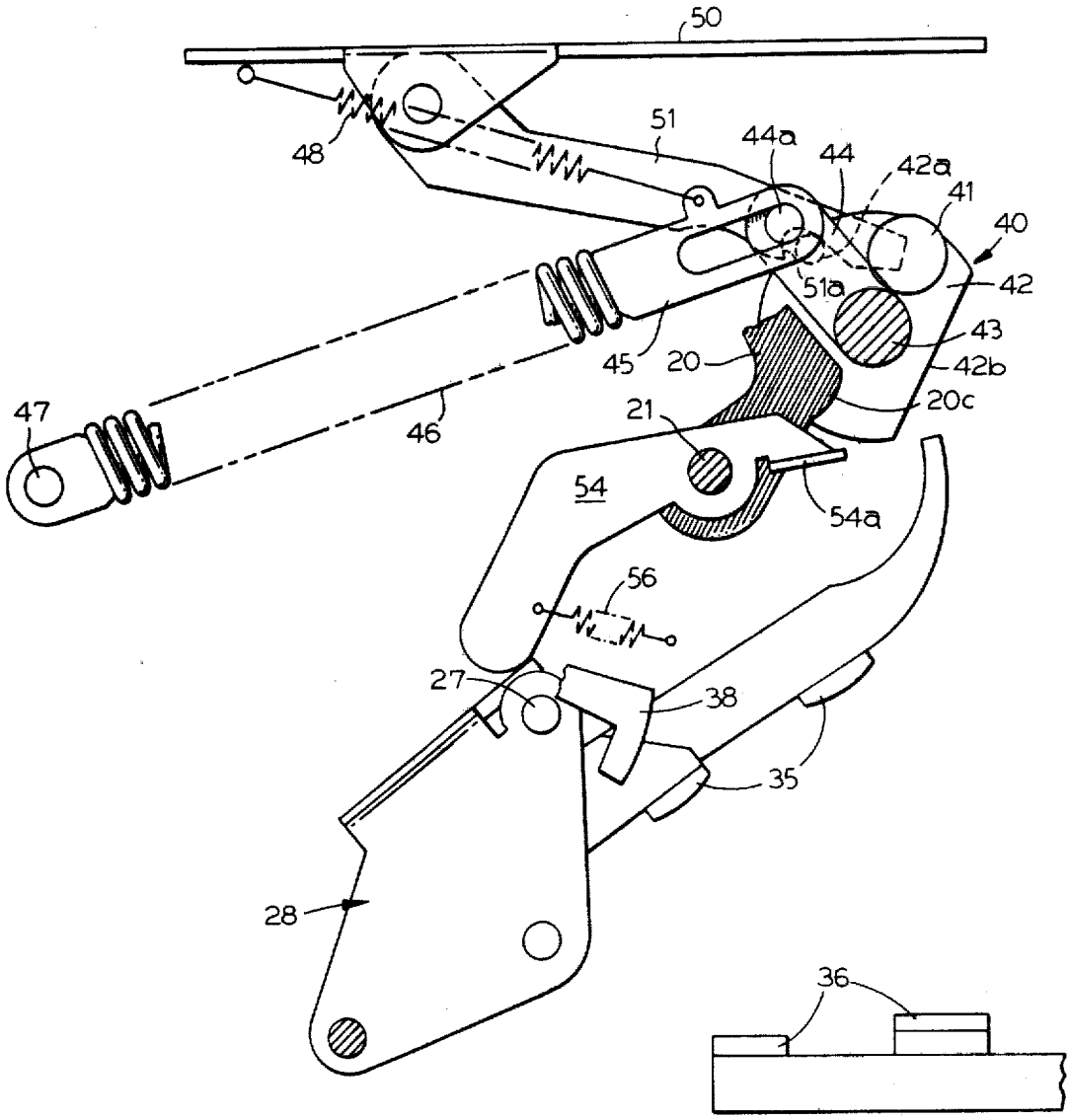
FIG. 2 is a simplified, side elevational view of a spring-powered charging mechanism utilized to charge the movable contact operating mechanism of FIG. 1.
Figure 3:
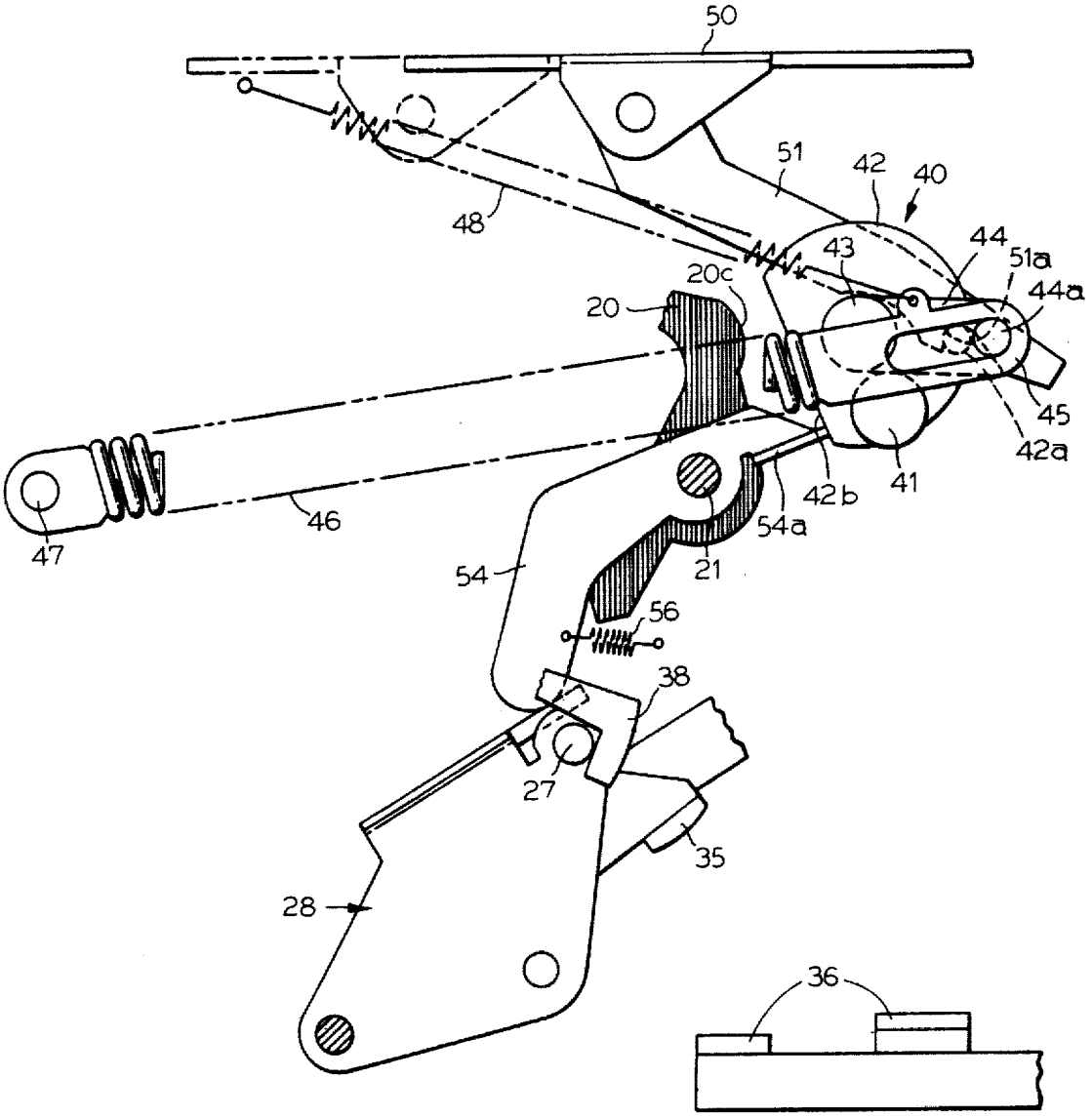
FIG. 3 is a simplified, side elevational view of the charging mechanism of FIG. 2 in its condition with a charge stored therein and while a charge is stored in the movable contact operating mechanism.
Figure 4:
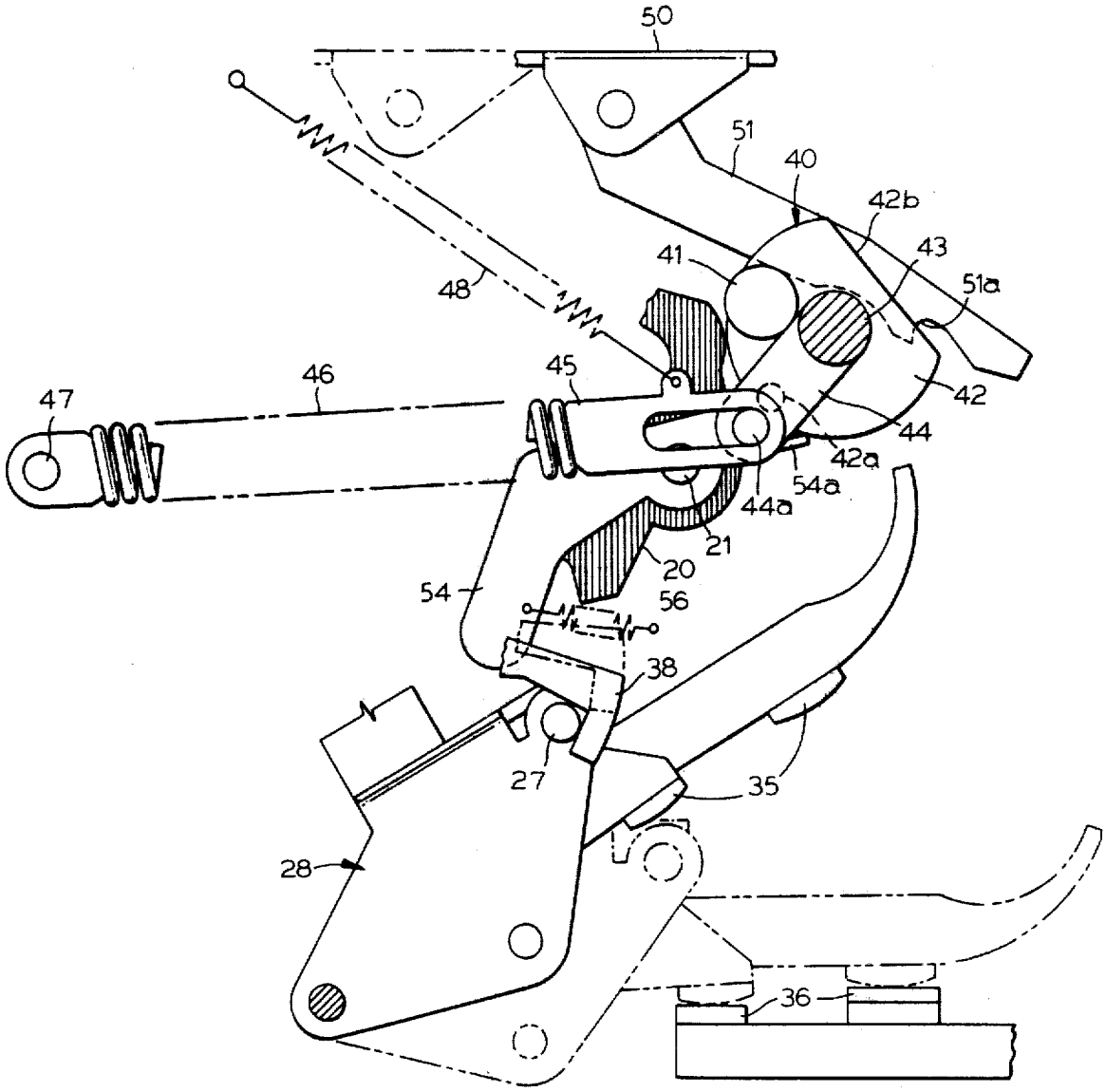
FIG. 4 is a simplified, side elevational view of the charging mechanism seen in its discharged condition while a charge is stored in the movable contact operating mechanism.

Reference is now had to FIGS. 2 through 4 for a review of the overall operation of the circuit breaker disclosed in the above-noted application, Ser. No. 52,276, and specifically the operation of a separate charging mechanism in charging the mechanism springs of the movable contact operating mechanism of FIG. 1. To induce counter-clockwise resetting pivotal movement of cradle 20, a bell crank assembly, generally indicated at 40, is provided with a reset roller 41 eccentrically mounted by a bell crank arm 42 carried by a shaft 43 journalled by the frame sideplates. Keyed to this shaft is an arm 44 which carries at its free end a pin 44*a* operating in an elongated slot in a spring anchor 45 secured to one end of a powerful tension spring 46. The other end of this spring is anchored to a stationary pin 47. As will be seen, when charging spring 46 discharges, bell crank assembly 40 is rotated clockwise to swing the reset roller around to engage a nose 20*c* of cradle 20, while in its tripped position, thereby driving the cradle in the counterclockwise direction to its latched reset position, in the process charging the contact operating mechanism springs 32 (FIG. 1).

Referring first to FIG. 2, bell crank assembly 40 is seen in its start angular orientation achieved by the action of a tension spring 48. An operator slide 50 is shown in its left-most return position with a pawl 51, pivotally connected thereto, retracted to a position where a notch 51*a* in its free end is in intercepting relation with an eccentric pin 42*a* carried by crank arm 42. From FIG. 3 it is seen that when slide 50 is propelled to the right through a breaker operating mechanism charging stroke, drive pawl 51 is pushed to the right. Its notch 51*a* picks up pin 42*a*, causing bell crank assembly 40 to be rotated in the clockwise direction. When the bell crank assembly reaches its angular position of FIG. 3, it is seen that charging spring 46 is stretched to a charged state. It is assumed, at this point in the description, that the movable contact operating mechanism of FIG. 1 is tripped, and thus cradle 20 is in its clockwise-most tripped position seen in FIG. 2. Under these circumstances, the essentially discharged contact operating mechanism springs 32 have lifted movable contact assemblies 28, to a counterclockwise-most tripped open position also seen in FIG. 2. In this position, the top surface of the center pole movable contact assembly engages and lifts the left lower end of a prop 54 pivotally mounted intermediate its ends by cradle pin 21. The upper end 54*a* of this prop is moved downwardly out of engaging relation with the arcuate surface portion of the bell crank arm against which it is normally engaged under the bias of a return spring 56.

As seen in FIG. 3, the rightward charging stroke of operator slide 50 is sufficient to carry the line of action of charging spring 46 through the axis of the bell crank assembly shaft 43. Consequently, with prop 54 in its FIG. 2 position, the charging spring immediately discharges and the bell crank assembly is thereby driven in the clockwise direction swinging reset roller 41 into engagement with nose 20*c* of cradle 20 in its tripped position of FIG. 2. The cradle is thus swung in the counterclockwise direction to its reset position as the discharging springs 78 drive the bell crank assembly to its angular position seen in FIG. 4. As cradle 20 is being reset, contact operating mechanism springs 32 are charged to exert a bias tending to drive the movable contact assemblies 28 to their closed circuit positions seen in phantom in FIGS. 1 and 4. However, hook 38 is in position to intercept pin 27 and detain the movable contact assemblies in their hooked position seen in FIGS. 3 and 4. By virtue of the loss motion coupling between bell crank assembly 40 and charging spring 46 afforded by the slot in spring anchor 45, spring 48 acts to continue the clockwise rotation of the bell crank assembly from its angular position of FIG. 4 around to its start position of FIG. 2 with pin 44*a* again bottomed against the right end of the spring anchor slot.

From the description thus far, it is seen that the first charge-discharge cycle of charging spring 46 has been effective in returning the contact operating mechanism cradle 20 to its latched reset position and charge springs 32 thereof, but the breaker contacts are sustained in their open circuit position by hook 38. At this point, the operator slide 50 can be motivated through a second rightward charging stroke to again charge spring 46. Since movable contact assemblies 28, in their hooked open position, have released prop 54, its upper end 54*a* rides on the arcuate surface portion of bell crank arm 42 as the bell crank assembly is rotated in a clockwise direction. Spring 56 elevates prop end 54*a* into intercepting relation with a flattened surface 42*b* of bell crank arm 42 at the conclusion of the operator slide charging stroke just as the line of action of the charging spring 46 passes below the axis of bell crank assembly shaft 43. Thus, as seen in FIG. 3, prop 54 serves to prevent further clockwise rotation of bell crank assembly 40, and the charging spring 46 is held in a fully charged condition. It is thus seen that while the breaker contacts are held in their hooked open circuit position by hook 38, both the charging spring 46 and contact operating mechanism springs 32 are poised in their fully charged conditions. At this point, hook 38 may be articulated to release the movable contact assemblies 28, whereupon they pivot to their closed circuit position under the urgence of mechanism springs 32. It will be noted that closure of the movable contacts has no effect on prop 54, and thus charging spring 46 is sustained in its fully charged condition.

When the circuit breaker is eventually tripped open by removal of latch 34 (FIG. 1), the unlatched cradle 20 swings clockwise to its tripped position, and the movable contact assemblies abruptly pivot upwardly to their tripped open position of FIG. 2, all under the urgence of the discharging contact operating mechanism springs 32. As the center pole movable contact assembly moves to its tripped open position, it picks up the lower end of prop 54, ducking its upper end out of engagement with the flat peripheral surface 42*b* of crank arm 42. The clockwise rotational restraint on the bell crank assembly is thus removed, and charging spring 46 abruptly discharges, swinging reset roller 41 around to drive cradle 20 from its tripped position of FIG. 2 back to its reset position of FIG. 3. The contact operating mechanism springs 32 are again charged, and the movable contact assemblies 28 move to their hooked open position seen in FIG. 4. At this point, the charging spring 46 may again be charged to create the condition depicted in FIG. 3, and the charge therein will be automatically stored by prop 54 until needed to recharge the contact operating mechanism springs 32. Alternatively, and more significantly, hook 38 may be articulated to precipitate closure of the breaker, and thereafter the breaker may be tripped open without charging the charging spring 46.

From the foregoing description, it is seen that with the breaker contacts open and its contact operating mechanism tripped, the charging spring can be put through a first charge-discharge cycle to charge the contact operating mechanism springs 32 and then a second charge which is stored by prop 54 until needed to re-charge the mechanism springs. Thus, the circuit breaker, starting in its tripped open condition and with two chargings of charging spring 46, can be, in sequence, closed, tripped open, reclosed and tripped open again without an intervening charging of the charging spring. It follows from this that the charging spring can be charged with the breaker contacts closed to achieve, in sequence, opening, closing and opening operations of the circuit breaker without an intervening charge.

Figure 5:
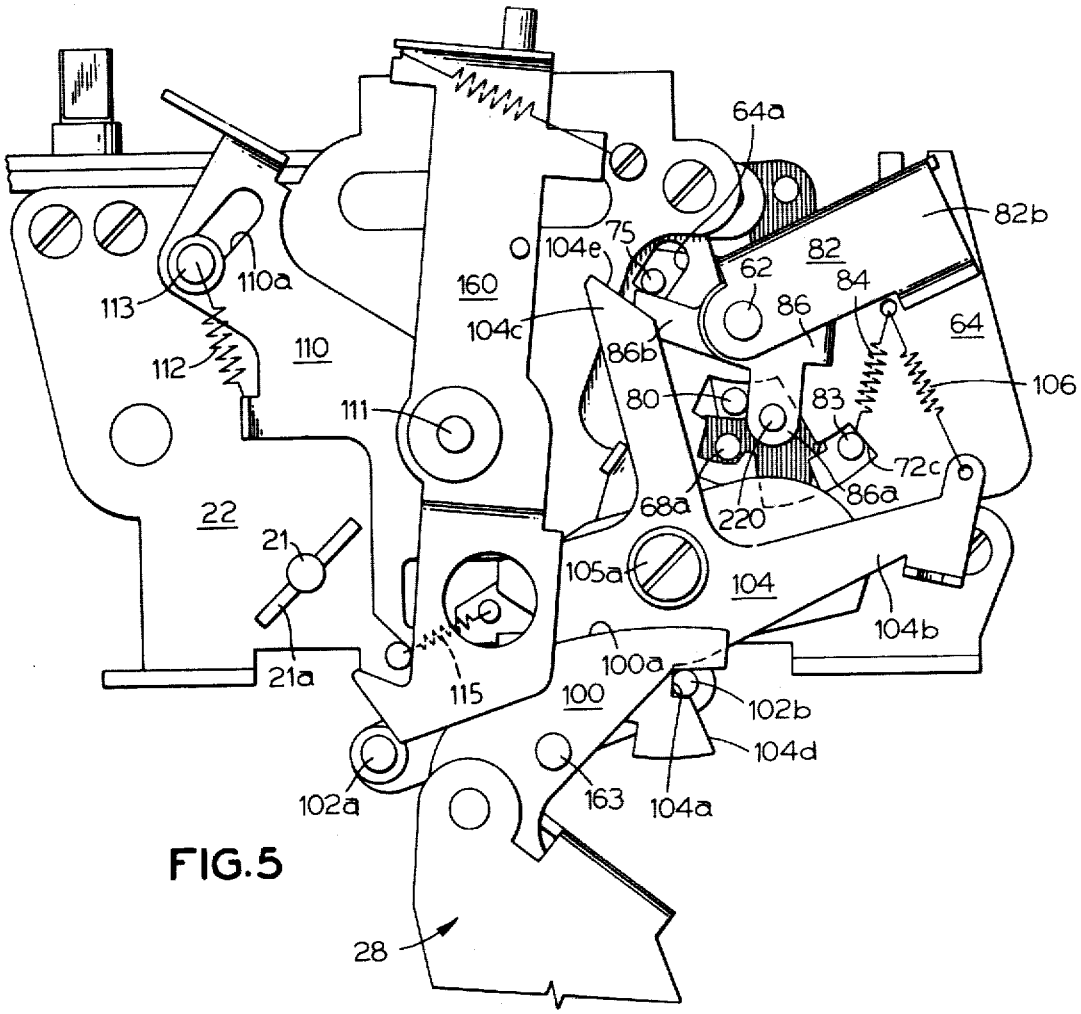
FIG. 5 is a side elevational view of an industrial circuit breaker showing an ON/OFF indicator arm and releaseable hook apparatus for holding the breaker movable contacts in their hooked open position of FIG. 3.
Figure 6:
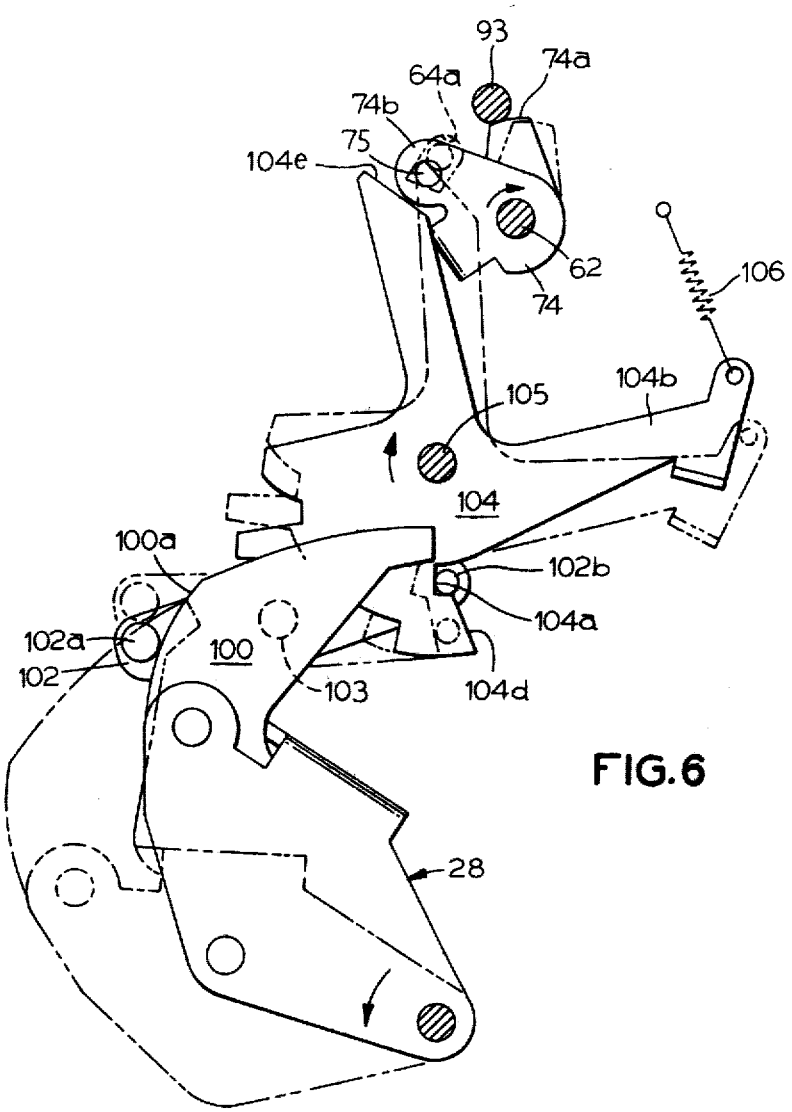
FIG. 6 is a simplified side elevational view of the hook apparatus of FIG. 5, illustrating its release of the breaker movable contacts from their hooked open position.

To contend with the high impact forces incident with stopping the movable contact assemblies 28 in their hooked open position of FIG. 1 as they spring from their closed circuit position while mechanism springs 32 are charged, a more elaborate hook arrangement than the simple hook 38 was necessitated. To this end, as seen in FIGS. 5 and 6, a cam plate 100, presenting an elongated, compound arcuate cam edge 100*a*, is mounted by the center pole movable contact assembly. This cam edge engages a roller pin 102*a* carried at the left end of an intermediate hook lever 102 which is pivotally mounted intermediate its ends on a pin 103 mounted by one of the mechanism frame sideplates 22. The other end of this intermediate hook lever carries a latch pin 102*b* which is latchably received in a notch 104*a* provided in a primary hook lever 104 which is pivotally mounted by a hub 105 (FIG. 6); this pivotal mounting being preserved by a screw 105*a* (FIG. 5). This primary hook lever includes a generally horizontally extending actuating arm 104*b* and an upstanding actuating finger 104*c*. A tension spring 106 biases the primary hook lever to a counterclockwise-most latching position with latch pin 102*b* of the intermediate hook lever lodged in notch 104*a*.

FIG. 5 depicts the movable contact assemblies in their tripped open position assumed when mechanism springs 32 (FIG. 1) are completely discharged. Under these circumstances, cam edge 100*a* is disengaged from roller pin 102*a* of intermediate latch lever 102. When, during the return of cradle 20 from its tripped position by the discharge of charging spring 46 (FIG. 4) pursuant to charging mechanism springs 32, the line of action of the mechanism springs moves to the right of toggle pivot pin 26 (FIG. 1) and the mechanism springs become empowered to straighten the toggle. The movable contact assemblies are thus abruptly propelled from their tripped open position toward their closed circuit position. This closing movement is arrested at the hooked open position when cam edge 100*a* impacts with roller pin 102*a* of intermediate hook lever 102. Since latch pin 102*b* is lodged in primary hook notch 104*a*, the clockwise movement exerted on the intermediate hook lever by the charging mechanism springs is resisted, and the movable contact assemblies are readily arrested in their hooked open position, seen in solid line in FIG. 6, while the cradle is being re-latched in its reset position.

To now unhook the movable contact assemblies for closure under the urgence of the fully charged mechanism springs, primary hook 104 is simply pivoted from its latching position in the clockwise direction to its unlatching position seen in phantom line in FIG. 6. This pivotal movement, which may be induced by a closing solenoid (not shown) acting on primary hook actuating arm 104*b*, disengages latch pin 102*b* from notch 104*a*. The clockwise pivotal restraint on intermediate hook 102 is thus removed, thereby unhooking the movable contact assemblies for movement to their closed circuit position under the urgence of the charged mechanism springs 32. During this closure movement, cam 100 propels intermediate hook 102 through an increment of clockwise rotation to an unhooking position. In the process, latch pin 102*b* acts on a sloping edge 104*d* of primary hook 104 beneath notch 104*a* to propel the primary hook through an increment of clockwise pivotal movement in addition to and independent of the closure initiating action on the primary hook in initially dislodging latch pin 102*b* from notch 104*a*. During this additional increment of clockwise primary hook pivotal movement to an extreme unlatching position induced solely by the closing movement of the movable contact assemblies, the upper edge 104*e* of primary hook finger 104*c* picks up pin 75 carried by a secondary latch 74 of a trip latch assembly which is disclosed in detail in the above-noted related application entitled Circuit Breaker Trip Latch Assembly. This secondary latch is thus rotated in the clockwise direction seen in FIG. 6 to swing its prop 74*a* out from under an intermediate latch pin 93 of the trip latch assembly.

As is described in this related application, whose disclosure is specifically incorporated herein by reference, secondary latch 74 is pivoted from its latching position to its unlatching position incident with the closure of the breaker contacts so as to then qualify a second secondary latch to initiate removal of primary latch 34 from cradle shoulder 20*a* (FIG. 1) pursuant to tripping the breaker. It is seen that this action is achieved by primary hook 104 acting in response to closure movement of the movable contact assemblies communicated thereto by cam 100 and intermediate hook 102. Preferably, the geometry of primary hook 104 is such that secondary latch pin 75 is not picked up until latch pin 102*b* is irretrievably dislodged from notch 104*a*. Thus, secondary latch 74 cannot be removed by the externally induced pivotal movement of the primary hook to initiate unhooking of the movable contact assemblies, but only when the movable contact assemblies are committed to closure. This precludes so-called "crashing" of the breaker operating mechanism while the movable contact assemblies are in their hooked open position by the spurious removal of both secondary latches of the trip latch assembly.

While the movable contact assemblies remain in their closed circuit position, cam 100 maintains intermediate hook 102 and primary hook 104 in their phantom line positions of FIG. 6 and secondary latch 74 is thus held in its phantom line removed or unlatching position to sustain the qualification of the second secondary latch to initiate tripping of the breaker. When the breaker is tripped, the movable contact assemblies spring to their trip open position where cam 100 releases intermediate hook 102, as seen in FIG. 5. Spring 106 is then free to pivot primary hook 104 in the counterclockwise direction back to its latching position. In the process, edge 104*d* thereof, acting on latch pin 102*b*, cams intermediate hook 102 in the counterclockwise direction to a hooking position where the latch pin is re-engaged in notch 104*a*. At the same time, primary hook finger 104*c* is displaced from pin 75, freeing secondary latch 74 for return to its latching position to which it is spring biased, which is effective to reset the trip latch assembly, again as detailed in the related trip latch assembly application. From FIG. 2 it will be recalled that prop 54 is not removed to initiate recharging of the mechanism springs 32 (FIG. 1) until the movable contact assemblies substantially achieved their tripped open position. Consequently, the resettings of the trip latch and the primary and intermediate hooks are effected essentially before recharging of the mechanism springs begins.

Figure 7:
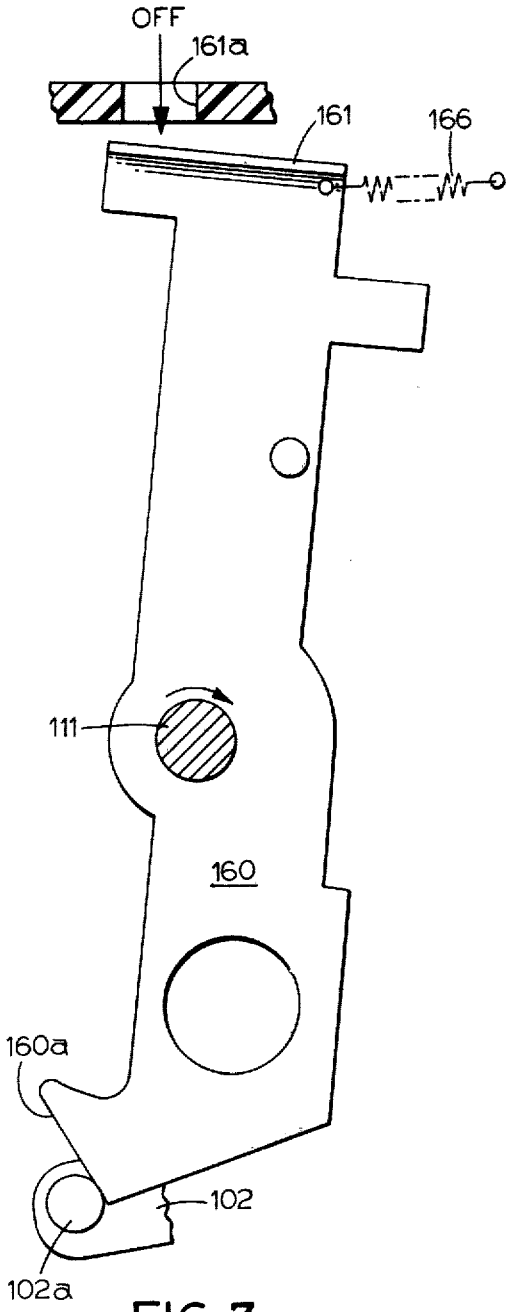
FIG. 7 is a simplified side elevational view of the indicator arm of FIG. 5 seen in its OFF indicating position assumed in response to the breaker contacts being open.
Figure 8:
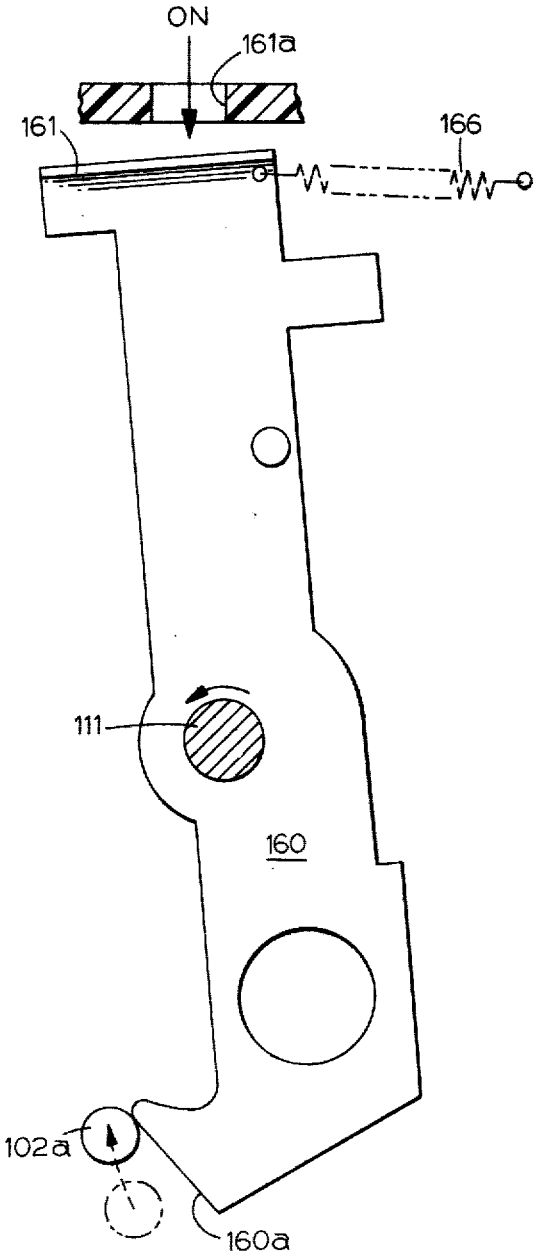
FIG. 8 is a simplified, side elevational view of the indicator arm of FIG. 5 seen in its ON indicating position assumed in response to the breaker contacts being closed.

As seen in FIGS. 5, 7 and 8 an indicator arm 160 is pivotally mounted by a pin 111 carried by one of the mechanism frame sideplates 22. This indicator arm is biased in the clockwise direction by a tension spring 166 to an OFF indicating position where indicia borne by a display panel carried at the upper end of the arm is registered in a cover window 161*a* identifies that the breaker contacts are open, i.e., the movable contact assemblies are either in their tripped open position of FIG. 2 or their hooked open position of FIG. 3. To assist spring 166 in shifting arm 160 to its OFF indicating position, hook pin 102*a* of intermediate hook lever 102, seen in FIGS. 5 and 6, is disposed to act on an angular lower edge 160*a* of the arm. Thus, when the intermediate hook is latched by primary hook 104 of FIGS. 5 and 6 in its hooking position to intercept hook cam 100 and thus hold the movable contact assemblies in their hooked open position upon arrival thereat from their tripped open position upon charging of the operating mechanism springs 32 (FIG. 1), hook pin 102*a* is disposed in its position of FIG. 7 to engage the lower portion of edge 160*a* and thereby establish the spring induced OFF indicating arm position.

When primary hook 104 is articulated in the clockwise direction to disengage its notch 104*a* from latch pin 102*b*, the movable contact assemblies are released from their hooked open position, as described in conjunction with FIG. 6. As the movable contact assemblies spring to their closed position under the urgence of the charged mechanism springs, the trailing edge of hook cam 100 swings the intermediate hook roller pin upwardly from its phantom line hooking position to its solid line unhooking position seen in FIG. 8. In the process, hook roller pin 102*a*, in acting against edge 160*a*, cams indicator arm 160 in the counterclockwise direction against the bias of spring 166 to an ON indicating position, where indicia borne by display panel 161 is registered in window 161*a* to identify the fact that the breaker contacts are now closed. It is apparent that when the breaker is tripped and the movable contact assemblies spring to their tripped open position, the intermediate hook is released by the hook cam and is automatically reset to its hooking position by the primary hook. The hook roller pin thus assumes its hooking position of FIG. 7, re-establishing the OFF indicating position of arm 160 to which it is biased by spring 166.

Figure 9:
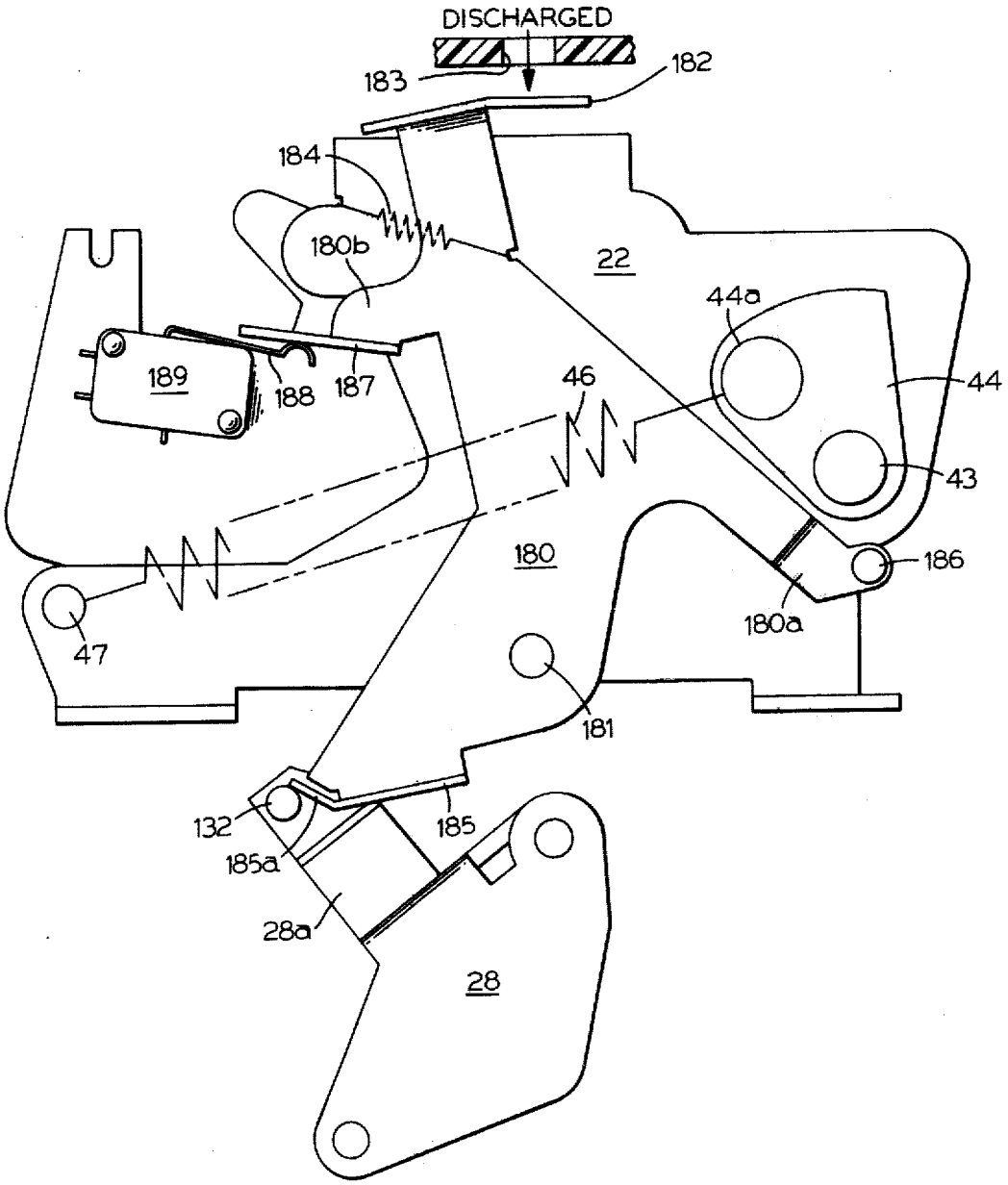
FIG. 9 is a simplified side elevational view of a second indicator arm seen in its DISCHARGED indicating position.
Figure 10:
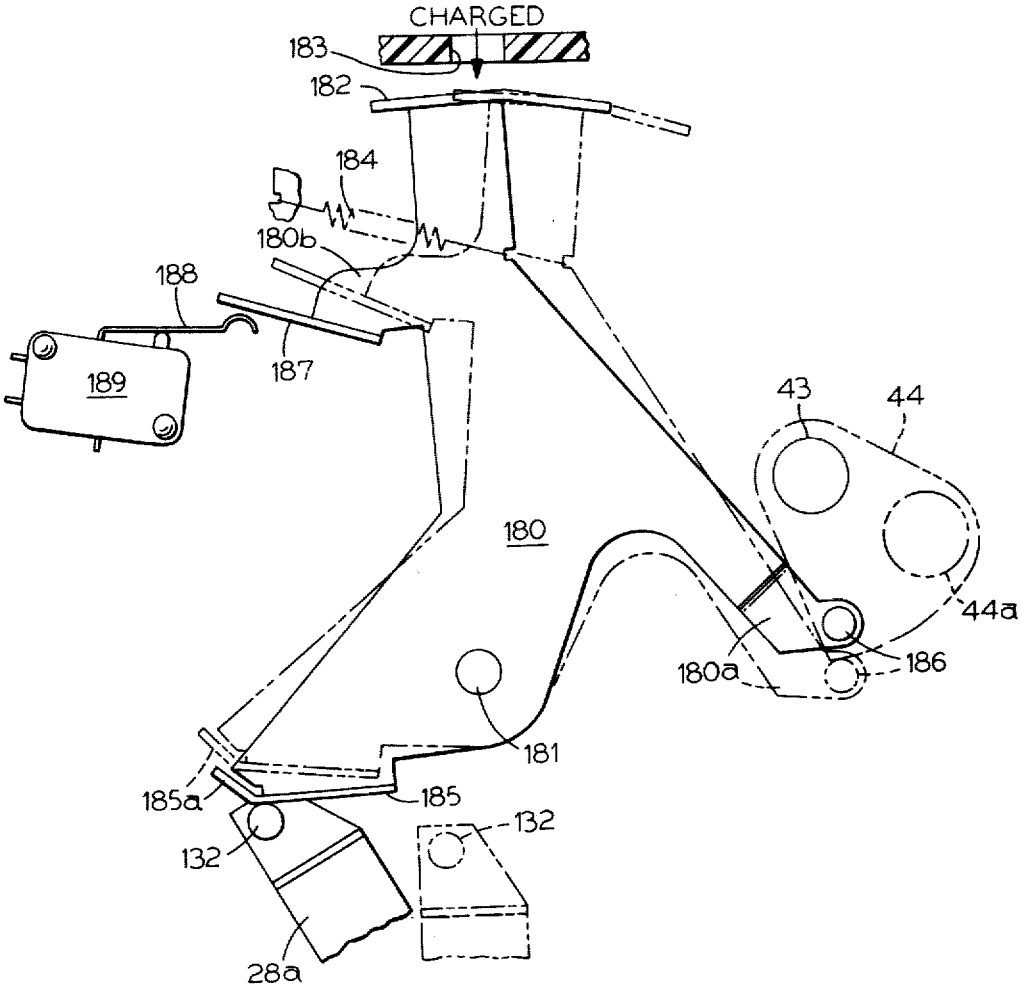
FIG. 10 is a simplified side elevational view of the second indicator arm of FIG. 9 seen in its CHARGED indicating position.

In addition to indicating the ON/OFF condition of the breaker, it is also important to advise personnel whether or not there is a charge stored in either the mechanism springs 32 (FIG. 1) or the charging springs 46 (FIG. 3). To this end, a charge indicator arm 180, seen in FIGS. 9 and 10, is pivotally mounted to the opposite side of the mechanism frame by a pin 181. The upper end of this arm carries a display panel 182 which bears the indicia DISCHARGED and two separate CHARGED indicia separately registerable with a breaker cover window 183. A tension spring 184 normally biases the charge indicator arm to its counterclockwise-most position seen in FIG. 9, determined by the engagement of a portion 185*a* of a laterally turned flange 185 carried at the lower end of the indicator arm with pin 132 mounted atop crossbar 28*a* when the movable contact assemblies are in their tripped open position. A depending leg 180*a* of the charge indicator arm carries a pin 186 which is engageable by arm 44 affixed to shaft 43 of bell crank assembly 40 seen in FIGS. 2 through 4. As previously described, this arm carries a pin 44*a* to which one end of charging spring 46 is anchored. The other end of the charging spring is anchored to the mechanism frame at 47. Arm 44 is seen in FIG. 9 in its angular position assumed when charging spring 46 is discharged, and pin 186 is in disengaged relation with the arm. Thus in the situation depicted in FIG. 9, both the mechanism springs and the charging spring are discharged, and spring 184 biases indicator arm 180 counterclockwise to a discharged indicating position determined by the abutment of flange portion 185*a* with pin 132. Display panel 182 is thus positioned to register the indicia DISCHARGED in cover window 183.

If the mechanism springs are charged, the movable contact assemblies assume their hooked open position, with pin 132 assuming its solid line position seen in FIG. 10. Indicator arm 180 is thus cammed clockwise to an intermediate charged indicating position where one of the CHARGED indicia borne by display panel 182 is registered in window 183. If the charging springs 46 are then charged, arm 44 swings clockwise to its phantom position seen in FIG. 10 which is sustained by prop 54 (FIG. 3). Pin 186 is picked up to pivot the indicator arm to its extreme clockwise position, seen in phantom, and the other CHARGED indicia borne by the display panel is registered in window 183.

When the breaker is closed, pin 132 assumes its phantom line position of FIG. 10, however, the indicator arm is sustained in its phantom line, charged indicating position by arm 44. If the breaker is then tripped, the movable contact assemblies spring to their tripped open position, removing prop 54 (FIG. 2). The charging spring 46 then discharges to recharge the mechanism springs 32 (FIG. 1), and the movable contact assemblies spring to their hooked open position with pin 32 assuming its solid line position of FIG. 10. With the discharge of charging spring 46, arm 44 assumes its position of FIG. 9 in disengaged relation to pin 186. Spring 184 pulls the indicator arm counterclockwise to its solid line, intermediate charged indicating position.

When the breaker is subsequently closed and pin 132 assumes its phantom line position of FIG. 10, spring 184 biases indicator arm 180 counterclockwise to its discharged indicating position of FIG. 9, this time determined by the engagement of a paddle 187 carried by a laterally extending arm 180*b* of the indicator arm with an actuating arm 188 of a normally closed, remote charged indicating switch 189. This switch is thus opened to interrupt an energizing circuit for a remotely located indicating means, such as a pilot light. Thus, with the pilot light extinguished and the DISCHARGED indicia registered in window 183, remote and local indications are given that no charge is stored in the operating mechanism by virtue of the movable contacts being held in their hooked open position and that no charge is stored in the charging mechanism by the prop. Consequently, notice is given that the circuit breaker is incapable of reclosure. From FIG. 9 it is seen that the switch is also opened to manifest the fact that the breaker is incapable of closure since, with the movable contacts in their tripped open position, both the operating and the charging mechanisms are discharged. When the indicator arm is in either of its charged indicating positions of FIG. 10, switch 189 is de-actuated and its closure lights the pilot light to give remote indication that either one or both of the mechanism and charging springs are charged and that the breaker is capable of reclosure. It is thus seen that the indicating positions of charge indicator arm 180 and ON/OFF indicator arm 160 serve to continuously advise personnel of the existing condition of the circuit breaker.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described our invention, what we claim as new and desire to secure by Letters Patent is:

1. Condition indicator apparatus for a circuit breaker having a spring-powered operating mechanism for motivating breaker movable contacts between tripped open and closed positions, and a spring-powered charging mechanism operatively coupled with the operating mechanism, the charging mechanism capable of being charged, storing such charge, and subsequently discharging to charge the operating mechanism, and hook means selectively operable to hold the breaker movable contacts in an intermediate hooked open position against the force of the charged operating mechanism acting to propel the movable contacts to their closed position, said apparatus comprising, in combination:

A. a first indicator arm mounted for movement between an ON indicating position, assumed in response to the movable contacts being in their closed position, and an OFF indicating position, assumed in response to the movable contacts being in either their tripped open or hooked open positions, B. a first display panel carried by said first arm and bearing indicia separately registerable in a window in the circuit breaker cover in accordance with the position of said first arm to locally indicate whether the breaker contacts are open or closed;

C. a second indicator arm mounted for movement between an uncharged indicating position, assumed in response to the movable contacts being in their tripped open position, and a charged indicating position, assumed in response to either the movable contacts being in their hooked open position or the charging mechanism having a charge stored therein; and D. a second display panel carried by said second indicator arm and bearing indicia separately registerable in a breaker cover window in accordance with the position of said second arm to locally indicate whether or not the breaker is capable of either closure while the contacts are open or reclosure while the breaker contacts are closed.

2. The condition indicator apparatus defined in claim 1, which further includes a switch selectively actuated in accordance with the indicating position of said second arm, such as to accommodate a remote indication of whether or not the breaker is capable of either closure while the contacts are open or reclosure while the breaker contacts are closed.

3. The condition indicator apparatus defined in claim 1, which further includes a spring normally biasing said first indicator arm to its OFF indicating position.

4. The condition indicator apparatus defined in claim 3, wherein said first arm includes means engageable by the hook means such as to be held in its ON indicating position by the hook means in its unhooked condition.

5. The condition indicator apparatus defined in claim 1, which further includes a spring normally biasing said second indicator arm to its uncharged indicating position.

6. The condition indicator apparatus defined in claim 5, wherein said second arm is equipped with first means engaged by an element carried by the movable contacts such as to be held in its charged indicating position while the movable contacts are in their hooked open position, and said second arm being equipped with second means engageable by an element of the charging mechanism such as to be held in its charged indicating position while a charge is stored in the charging mechanism.

7. The condition indicator apparatus defined in claim 6, wherein said second arm is mounted for movement between said discharged indicating position and first and second charged indicating positions, said second arm being held in its first charged indicating position while said movable contacts are in their hooked open position and held in its second charged indicating position while a charge is stored in the charging mechanism.

8. The condition indicator apparatus defined in claim 7, which further includes a spring normally biasing said first indicator arm to its OFF indicating position.

9. The condition indicator apparatus defined in claim 8, wherein said first arm includes means engageable by the hook means such as to be held in its ON indicating position by the hook means in its unhooked condition.

10. The condition indicator apparatus defined in claim 9, which further includes a switch selectively actuated in accordance with the indicating position of said second arm, such as to accommodate a remote indication of whether or not the breaker is capable of either closure while the contacts are open or reclosure while the breaker contacts are closed.

* * * * *